United States Patent [19]

Watanabe et al.

[11] Patent Number: 4,850,138

[45] Date of Patent: Jul. 25, 1989

[54] DOOR WITH AN ADJUSTABLE LOUVER

[75] Inventors: Kayo Watanabe; Akira Saito; Yoshihiro Aoki, all of Fukui, Japan

[73] Assignee: Fukubi Kagaku Kogyo Kabushiki Kaisha, Japan

[21] Appl. No.: 18,921

[22] Filed: Feb. 25, 1987

[30] Foreign Application Priority Data

Feb. 26, 1986 [JP] Japan ..... 61-27900

[51] Int. Cl.[4] ..... E06B 7/08

[52] U.S. Cl. ..... 49/84; 49/86; 49/92; 160/107; 160/236

[58] Field of Search ..... 49/73, 74, 82, 84, 85, 49/86, 92; 160/107, 236, 232, 172, 166.1, 178.1, 176 R

[56] References Cited

U.S. PATENT DOCUMENTS

| | | | |
|---|---|---|---|
| 2,405,255 | 8/1946 | Horton | 160/173 |
| 2,440,769 | 5/1948 | Hackett | 160/173 |
| 2,700,803 | 2/1955 | Graham | 49/86 |
| 4,254,581 | 3/1981 | Ishihara | 49/75 |

FOREIGN PATENT DOCUMENTS

| | | | |
|---|---|---|---|
| 781767 | 4/1968 | Canada | 160/107 |
| 344596 | 11/1936 | Italy | 49/92 |

*Primary Examiner*—Kenneth J. Dorner
*Assistant Examiner*—Gerald A. Anderson
*Attorney, Agent, or Firm*—Kane, Dalsimer, Sullivan, Kurucz, Levy, Eisele & Richard

[57] ABSTRACT

A door for use in a building, which includes a door frame defining an opening, and a louver arranged in the opening of the door frame. The louver includes a plurality of slats aligned parallel to each other. Each of the slats is connected at its opposite ends to the door frame so that the slat is pivoted about an axis generally coincidental with its centerline. The door also includes an adjusting assembly for pivoting the slats, and a connecting member for connecting all the slats. The adjusting assembly includes a rotatable lug member connected to one of the slats so that the slat is pivoted when the lug member is rotated. Due to the connecting member, the slats are simultaneously pivoted in the same direction when one of the slats is pivoted.

2 Claims, 4 Drawing Sheets

DOOR WITH AN ADJUSTABLE LOUVER

BACKGROUND OF THE INVENTION

This invention relates to a door provided with an adjustable louver for ventilation and natural lighting, the door being applicable as a swing door, a sliding door and the like.

Doors for use in a building, for instance, room doors and closet doors are sometimes provided with louvers. In conventional doors of this type, louvers deflect the flow of air or the radiation of light, but are unable to control either the flow rate of air or the quantity of light since, in many cases, they are merely fixed to the doors. Some of the louvers are used only for decorative purposes, thus the slats of these louvers are kept closed in order that the air-conditioning effect in particular rooms with air conditioners is enhanced.

However, regarding the recent improvements of the residential environments, louvers on the doors should have the inclination of their slats adjusted in accordance with the particular environment in which each of them is installed.

SUMMARY OF THE INVENTION

Accordingly, it is an object of the present invention to provide a door having a louver, in which the louver is capable of continuously and simultaneously adjusting the inclinations of its slats, thus controlling the flow rate and the flow direction of air passing therethrough.

Another object of the present invention is to provide a door with an adjustable louver, which is simply structured, thus being uncostly and easy to operate.

With these and other objects in view, the present invention provides a door comprising a door frame defining an opening, and a louver arranged in the opening of the door frame. The louver includes a plurality of slats aligned parallel to each other. Each of the slats is connected at its opposite ends to the door frame so that the slat is pivoted about an axis generally coincidental with its centerline. The door also comprises an adjusting assembly for pivoting the slats, and connecting means for connecting all the slats. The adjusting assembly has a rotatable lug member connected to one of the slats so that the slat is pivoted when the lug member is rotated. Due to the connecting means, the slats are simultaneously pivoted in the same direction when one of the slats is pivoted by the rotating operation of the lug member.

The slat connected to the lug member may have a pivotal pin projecting from one end face of the slat, coaxially with the pivotal axis of the slat. The adjusting assembly may include a worm wheel coaxially attached to the pivotal pin of the slat, and a worm meshed with the worm wheel. The worm must be attached to the lug member in order to be turned about its axis by the rotation of the lug member. The connection between the worm and the worm wheel prevents the lug from being rotated due to wind pressures or external forces exerted on the slat. In other words, the slat is not unnecessarily pivoted either by winds or by external forces.

It is preferred that each of the slats has an engaging hole formed in that portion of one of its end faces in the vicinity of one of its side edges. It is also preferred that the connecting means comprises a string body disposed in the same direction in which the slats are aligned, and a plurality of engaging pins projecting transversely from the string body at a pitch. The engaging pins are inserted respectively into the engaging holes of the slats so that the engaging pins are rotatable relative to the slats.

Preferably, the slats are spaced a pitch such that the slats bring their side edge portions into contact with each other when the slats are pivoted to a predetermined position.

DETAILED DESCRIPTION OF THE PREFERRED EMBODIMENT

Figure 1:
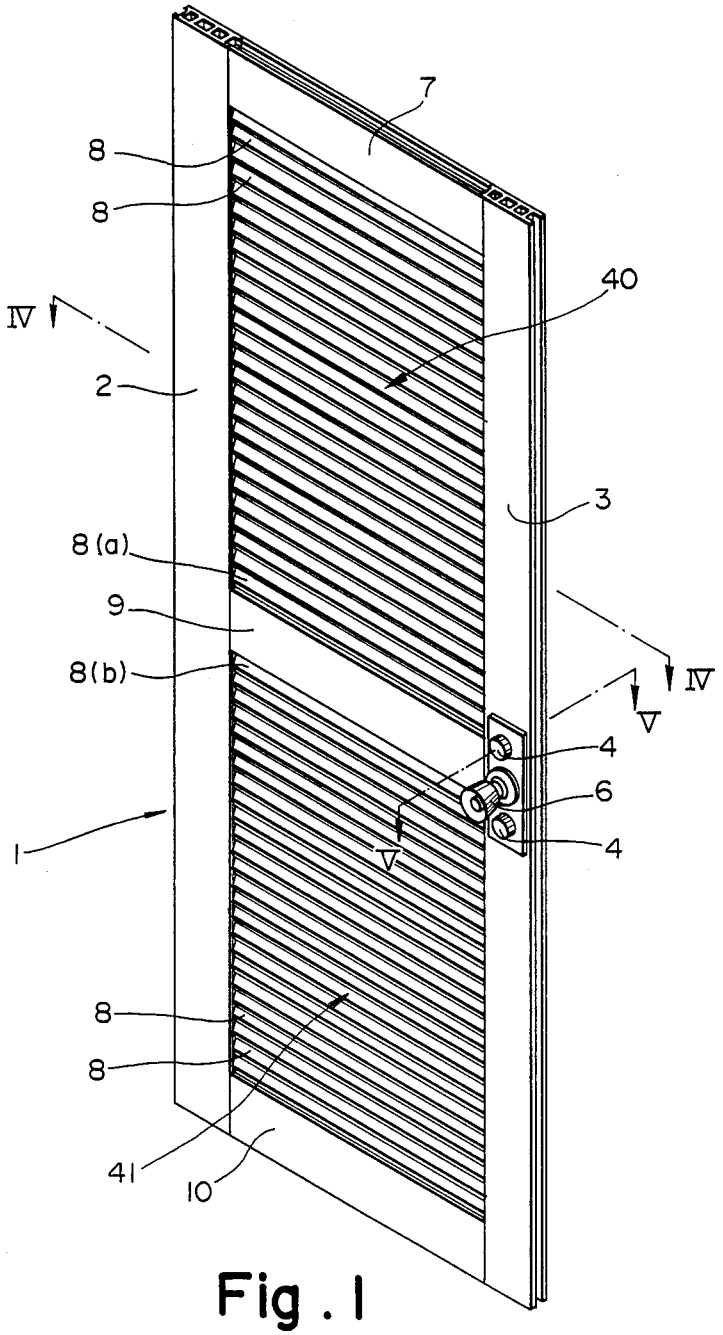
FIG. 1 is a perspective view of a door according to the present invention.

Referring now to the drawings, wherein like reference characters designate corresponding parts throughout several views, and descriptions of the corresponding parts are omitted after once given.

Figure 6:
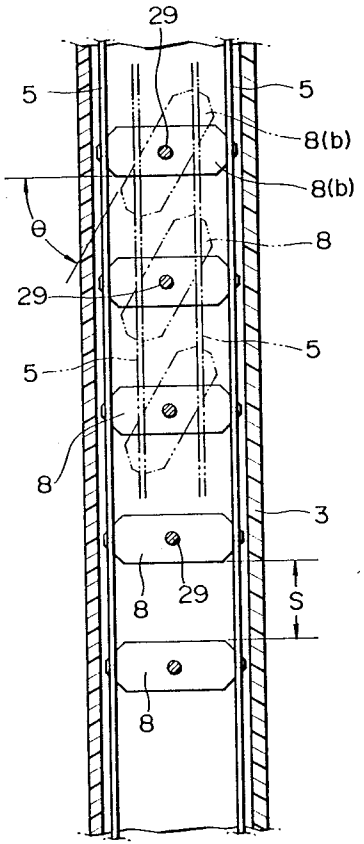
FIG. 6 is a view taken along the line VI—VI in FIG. 4.

FIG. 1 shows a door according to the present invention, which is to be arranged for the passage into and out of a room in a building. The reference numeral 1 designates a door frame which includes a pair of stiles 2 and 3, and three rails 7, 9 and 10. The stiles 2 and 3 are disposed parallel to each other, and the rails 7, 9 and 10 bridge the distance between the stiles 2 and 3. Specifically, the rail 7 bridges the upper ends of the stiles 2 and 3, the rail 9 bridges the intermediate portions of the stiles 2 and 3, and the rail 10 bridges the lower ends of the stiles 2 and 3. Therefore, there is formed two openings in the door frame 1, wherein the upper opening is defined by the stiles 2 and 3 and the upper and middle rails 7 and 9, and the lower opening is defined by the stiles 2 and 3 and the middle and lower rails 9 and 10. In these openings, there are provided two louvers 40 and 41 respectively. Each of the louvers 40 and 41 has a plurality of slats 8 aligned parallel to each other at equal vertical spaces S (see FIG. 6).

Figures 2, 3:
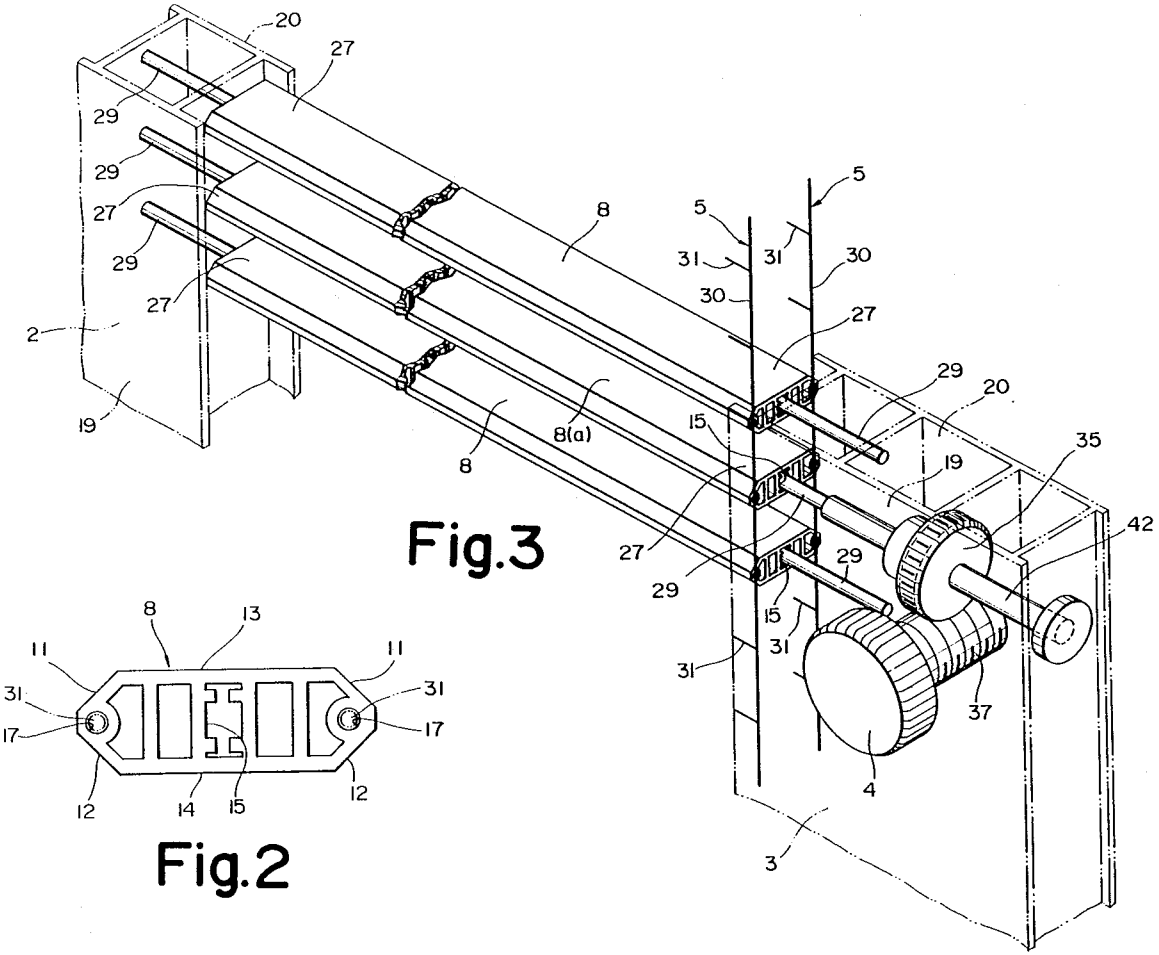
FIG. 2 is an enlarged front view of a slat in FIG. 1.
FIG. 3 is a fragmentary perspective view of the door in FIG. 1.

As shown in FIG. 2, each of the slats 8 has four chamfers 11, 11, 12 and 12, wherein the chamfers 11 and 11 are formed along the side edges of the upper face 13 of the slat 8 respectively, and the chamfers 12 and 12 are formed along the side edges of the lower face 14 of the slat 8 respectively. Thus, the cross-section of each slat 8 is substantially fusiform. The inclination angles of the upper chamfers 11 relative to the upper face 13 of the slat 8 are equal to each other. The inclination angles of the lower chamfers 12 relative to the lower face 14 of the slat 8 are equal to each other. The inclination angles of the upper and lower chamfers 11 and 12 are also equal to each other. For example, each of these inclination angles is about 45°.

Besides, each of the opposite end faces of the slat 8 has a square mounting hole 15 formed in its central portion, and a pair of engaging holes 17 and 17 formed in its opposite side portions. As illustrated in FIG. 3, a pair of pivotal pins 29 are inserted at their inner end portions 33 (see FIG. 4) into the mounting holes 15 of the opposite end faces of each slat 8. That is, each slat 8 is provided at its opposite ends with the pivotal pins 29 projecting longitudinally from its opposite end faces. The outer end potion of each pin 29 has a circular cross-section, but its inner end portion has a square cross-section. Thus, as shown in FIG. 2, the inner end portion of each pivotal pin 29 fits in the corresponding mounting hole, whereby the pin 29 is prevented from rotating relative to the slat 8.

Figure 4:
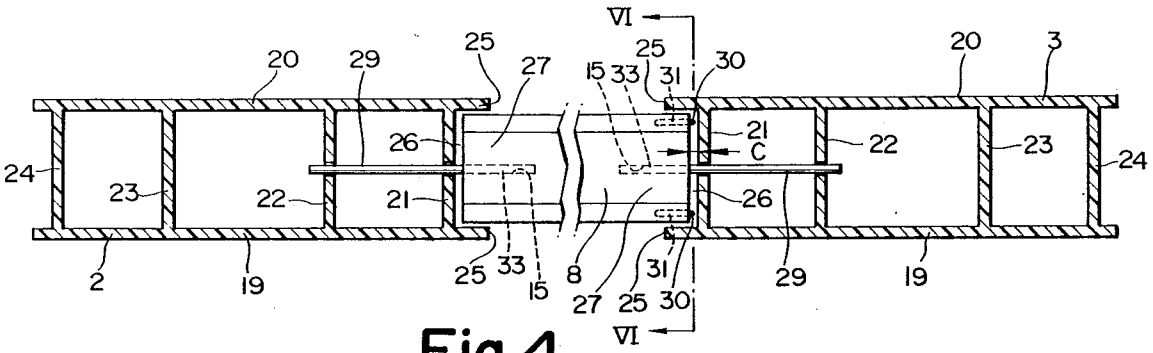
FIG. 4 is a view taken along the line IV—IV in FIG. 1.

As illustrated in FIG. 4, each of the stiles 2 and 3 consists of a pair of side plates 19 and 20 disposed parallel to each other, and four vertical partition plates 21, 22, 23 and 24 bridging the distance between the side plates 19 and 20 at generally equal distances. The innermost partition plate 21 of each stile is positioned at a predetermined horizontal distance from both the inner edges 25 of the side plates 19 and 20, whereby a groove 26 is defined by both the innermost partition plate 21 and the inner edge portions of the side plates 19 and 20. In short, the stiles 2 and 3 have the grooves 26 along their inner faces. These grooves 26 and 26 receive the opposite end portions 27 and 27 of each slat 8 respectively, while the pivotal pins 29 and 29 of the slat 8 are loosely passed through the partition plates 21 and 22 of the respective stiles 2 and 3. In other words, each of the slats 8 is supported at its pivotal pins 29 by the stiles 2 and 3 so that it can be pivoted about the pivotal pins 29. When a slat 8 is pivoted, the inclination angle $\theta$ (see FIG. 6) of the slat 8 with respect to a horizontal level is continuously varied. The more the slat 8 is inclined relative to a horizontal level, the more the width of the space between the adjacent slats 8 decreases. From this point of view, the space S between the adjacent slats in their horizontal states is such that the space S is completely closed when the slats 8 are inclined to a predetermined angle.

Returning to FIG. 4, a clearance is retained, for the pivoting movement of the slat 8, between each of the opposite end faces of the slat 8 and the corresponding innermost partition plate 21 of the stile. In particular, the the width of the clearance C between the stile 3 and the right end face of the slat 8 is such that a pair of connecting strings 5 are disposed in it. As illustrated in FIG. 3, each of the connecting strings 5 is composed of a string body 30, such as a piano wire, disposed along the groove 26 of the stile 3, and a plurality of engaging pins 31 spaced pitch P and projecting transversely from the string body 30. The pitch P is equal to the pitch at which the slats 8 are spaced. Each engaging pin 31 of one of the connecting strings 5 is inserted into the engaging hole 17 at one side of the corresponding slat 8 so that it is rotatable with respect to the slat 8, and each engaging pin 31 of the other connecting string 5 is inserted into the engaging hole 17 at the other side of the corresponding slat 8 so that it is rotatable relative to the slat 8. Naturally, the clearance C is as large as or slightly larger than the diameter of the string body 30, therefore the engaging pins 31 of each connecting string 5 are prevented from disconnecting from the engaging holes 17 of the slats 8.

Figure 5:
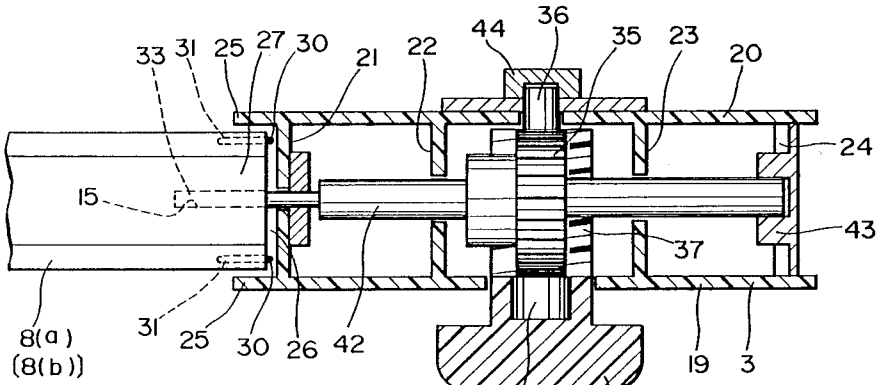
FIG. 5 is a view taken along the line V—V in FIG. 1.
Figure 8:
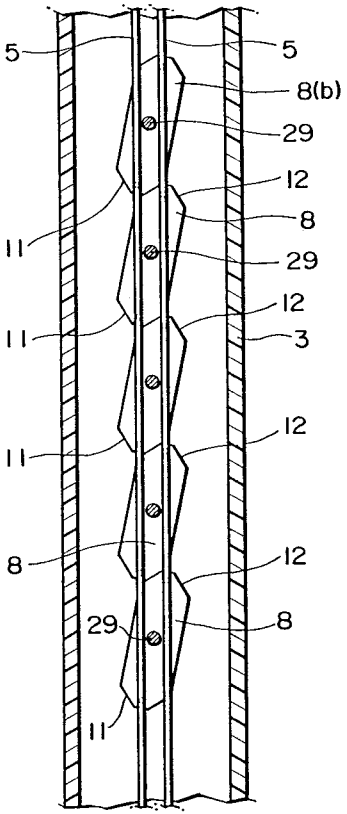
FIG. 8 is a vertical sectional view of the door in FIG. 1, showing the slats being closed in different way from the FIG. 7.

Returning to FIG. 1, the lowermost slat 8(*a*) of the upper louver 40 and the uppermost slat 8(*b*) of the lower louver 41 are connected respectively with the adjusting lugs 4 and 4 arranged on those portions of the stile 3 which are on the upper and lower sides of the door knob 6. More specifically, as shown in FIG. 5, the right pivotal pin 29 of each of the slats 8(*a*) and 8(*b*) is provided with a supporting shaft 42 coaxially attached at its one end to the outer end portion of the pivotal pin 29. This supporting shaft 42 passes through both the partition plates 22 and 23 of the stile 3 and is received at its other end in a bushing 43 formed on the outermost partition plate 24. Around that portion of the supporting shaft 42 between the partition plates 22 and 23, a worm wheel 35 is fixed. This worm wheel 35 is meshed with a worm 37 which is attached around a supporting rod 36 disposed perpendicular to the supporting shaft 42. One of the end portions of the supporting rod 36 passes through the side plates 20 of the stile 3, and is received in a bushing 44 provided on the side plate 20. The other end portion of the supporting rod 36 passes through the side plate 19, and joins with the corresponding adjusting lug 4.

When the lower lug 4 is turned, the corresponding worm 37 is rotated, causing the corresponding worm wheel 35 to turn. Then, the torque of the worm wheel 35 is transferred via supporting shaft 42 to the pivotal pin 29 of the uppermost slat 8(*b*) of the lower louver 41, resulting in the pivoting movement of the uppermost slat 8(*b*). For example, when the uppermost slat 8(*b*) is pivoted from the position shown by the solid line in FIG. 6 to the position shown by the phantom line, the right side edges of all the other slats 8 are pulled upwards since the uppermost slat 8(*b*) is connected with all the other slats 8 of the lower louver 41 via the connecting strings 5. That is to say, all the slats 8 of the lower louver 41 are simultaneously pivoted in the same direction and at the same angle as the uppermost slat 8(*b*). Accordingly, the turning of the lower lug 4 simultaneously and continuously adjusts the inclination angles of all the slats 8 of the lower louver 41 and also the widths of all the spaces between the slats 8. In the same manner as in the case of the lower lug 4, the turning operation of the upper lug 4 adjusts the inclination angles of all the slats 8 of the upper louver 40 and the widths of all the spaces between the slats 8. Thus, the door of the aforementioned construction is not only capable of deflecting the air flow going through its louvers but also of controlling the flow rate of air.

Figure 7:
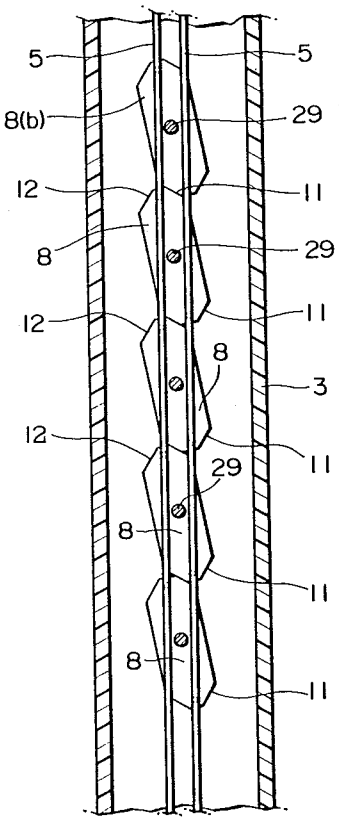
FIG. 7 is a vertical sectional view of the door in FIG. 1, showing the slats being closed.

In addition, when the slats 8 are pivoted from a horizontal level to the position shown in FIG. 7, each of the slats 8 brings one of its lower chamfers 12 into direct contact with one of the upper chamfers 11 of the lower adjoined slat 8, thus completely closing the spaces between the slats 8. The spaces between the slats 8 are also closed when the slats 8 are pivoted in the reverse direction to the position shown in FIG, 8. In this case, each of the slats 8 brings its other lower chamfer 12 into direct contact with the other upper chamfer 11 of the lower adjoined slat 8.

The pivotal pins 29 of each slat 8 may include the inner end portions having circular cross-sections. These pins with round inner portions are idled respectively in the mounting holes 15 of the slats 8 when the corresponding lug is operated after the spaces between the slats 8 are closed. Therefore, the pins prevent the slat 8 from being subjected to an unnecessary torque transferred from the lug 4.

One of the connecting strings 5 may be omitted to simplify the construction. On the other hand, another pair of the connecting strings 5 may be employed in the groove 26 of the stile 2. Such a construction is suitable for the relatively long sized slats to be operated in a stable manner.

Instead of the louvers 40 and 41, a louver that covers almost the whole door may be employed, or a louver which occupies a part of the door may be employed. Also, louvers having vertically disposed slats may be employed in place of the louvers 40 and 41.

The supporting rod 36 may be attached at its opposite ends with lugs, whereby the slats 8 are operated from the opposite sides of the door.

It is understood that although preferred embodiment of the present invention has been shown and described, various modifications thereof will be apparent to those skilled in the art, and, accordingly, the scope of the present invention should be defined only by the appended claims and equivalents thereof.

What is claimed is:

1. A door for use in a building, the door comprising:

a door frame defining an opening;

a louver arranged in the opening of the door frame, the louver including a plurality of slats aligned parallel to each other at a pitch, each said slat having an end face at each end, each slat being connected at its opposite ends to the door frame so that the slat is pivoted about an axis generally coincidental with the centerline thereof;

an adjusting assembly for pivoting the slats, the adjusting assembly including a rotatable lug member connected to one of the slats so that the slat is pivoted when the lug member is rotated, said slat connected to said lug member having a pivotal pin projecting from one end face coaxially with the pivotal axis of said slat, said pivotal pin having an inner end portion with a circular cross section, said end face of said slat having a mounting hole into which the inner end portion of said pivotal pin is inserted, said inner end portion of said pivotal pin being idleable within said mounting hole, said adjusting assembly having a worm wheel coaxially disposed on said pivotal pin, and a worm meshed with said worm wheel and drivingly attached to said lug member so that the slat is pivoted about its axis when said lug member is rotated; and connecting means for connecting all the slats so that the slats are simultaneously pivoted in the same direction when one of the slates is pivoted, each of said slats having first and second opposite side faces, the first face being provided with a pair of first chamfers formed respectively along the side edges of the first face, the second face being provided with a pair of second chamfers formed respectively along the side edges of the second face, said pitch being such that one of the first chamfers of each of the slats is brought into contact with one of the second chamfers of the adjoining slat when the slats are pivoted to predetermined postions, each of said slats having an engaging hole formed in one of said end faces between said first and second chamfers, said connecting means including a string body disposed in the same direction in which the slats are aligned, and a plurality of enagaging pins projecting transversely from the string body at a pitch, said engaging pins inserted respectively into said engaging holes of the slats, said engaging pins being rotatable relative to said engaging holes, and said pivot pin idling within said mounting hole when said lug member is rotated after said chamfers of said slats contact each other.

2. A door according to claim 1, wherein the first chamfers are inclined to the first face at equal angles, and wherein each of the second chamfers is inclined to the second face at an angle equal to the angle at which each of the first chamfers is inclined to the first face.

* * * * *